US009932682B2

(12) United States Patent
Shimokawa et al.

(10) Patent No.: US 9,932,682 B2
(45) Date of Patent: Apr. 3, 2018

(54) METHOD FOR MANUFACTURING ELECTROLYTIC COPPER

(71) Applicants: PAN PACIFIC COPPER CO., LTD., Tokyo (JP); KYOTO UNIVERSITY, Kyoto, Kyoto (JP)

(72) Inventors: Kimihiro Shimokawa, Oita (JP); Kuniaki Murase, Kyoto (JP); Atsushi Kitada, Kyoto (JP); Takahito Kasuno, Kyoto (JP)

(73) Assignees: PAN PACIFIC COPPER CO., LTD., Tokyo (JP); KYOTO UNIVERSITY, Kyoto (JP)

( * ) Notice: Subject to any disclaimer, the term of this patent is extended or adjusted under 35 U.S.C. 154(b) by 152 days.

(21) Appl. No.: 14/411,011

(22) PCT Filed: Sep. 10, 2013

(86) PCT No.: PCT/JP2013/074437
§ 371 (c)(1),
(2) Date: Dec. 23, 2014

(87) PCT Pub. No.: WO2014/136296
PCT Pub. Date: Sep. 12, 2014

(65) Prior Publication Data

US 2016/0017508 A1 Jan. 21, 2016

(30) Foreign Application Priority Data

Mar. 7, 2013 (JP) ..... 2013-045806

(51) Int. Cl.

| | |
|---|---|
| ***C25C 7/02*** | (2006.01) |
| ***C25C 1/12*** | (2006.01) |
| ***C22C 9/00*** | (2006.01) |

(52) U.S. Cl.
CPC ..... *C25C 7/02* (2013.01); *C22C 9/00* (2013.01); *C25C 1/12* (2013.01)

(58) Field of Classification Search
None
See application file for complete search history.

(56) References Cited

U.S. PATENT DOCUMENTS 4,474,649 A * 10/1984 Goffman ..... C25C 1/12 204/400
4,789,445 A * 12/1988 Goffman ..... C25C 1/16 204/434

(Continued)

FOREIGN PATENT DOCUMENTS

JP 1-139788 A 6/1989
JP 2-185990 A 7/1990

(Continued)

OTHER PUBLICATIONS

Chen et al, A Mineralogical Study of the Deportment and Reaction of Silver during Copper Electrorefining, Meallurgical Transactions B, Jun. 1989, vol. 20, Issue 3, pp. 345-361.*

(Continued)

*Primary Examiner* — Harry D Wilkins, III
(74) *Attorney, Agent, or Firm* — Birch, Stewart, Kolasch & Birch, LLP

(57) ABSTRACT

Provided is a method for producing electrolytic copper having a low Ag content by successfully suppressing the Ag concentration in an electrolytic solution. The electrolytic copper production method involves a step in which blister copper comprising Ag is used as an anode, and electrolysis is carried out under sulfuric acid acidity while maintaining the anode electric potential at a relatively low electric potential in comparison to the electric potential of the Ag elution.

13 Claims, 4 Drawing Sheets

(56) References Cited

U.S. PATENT DOCUMENTS

| | | | | |
|---|---|---|---|---|
| 6,267,853 | B1 * | 7/2001 | Dordi | C25D 17/001 204/232 |
| 2004/0244534 | A1 * | 12/2004 | Kojo | 75/643 |
| 2010/0028198 | A1 * | 2/2010 | Fabian | C22B 3/0097 420/469 |

FOREIGN PATENT DOCUMENTS

| | | | |
|---|---|---|---|
| JP | 6-172881 | A | 6/1994 |
| JP | 8-176878 | A | 6/1994 |
| JP | 2008-297565 | A | 12/2008 |

OTHER PUBLICATIONS

Wang, Impurity Control and Removal in Copper Tankhouse Operations, JOM, vol. 56, No. 7, Jul. 2004, pp. 34-37 (Year: 2004).*

English translation of the International Preliminary Report on Patentability dated Sep. 17, 2015 (Forms PCT/IB/338, PCT/IB373 and PCT/ISA/237).

International Search Report, dated Dec. 24, 2013, issued in PCT/JP2013/074437.

* cited by examiner

[Figure 1]
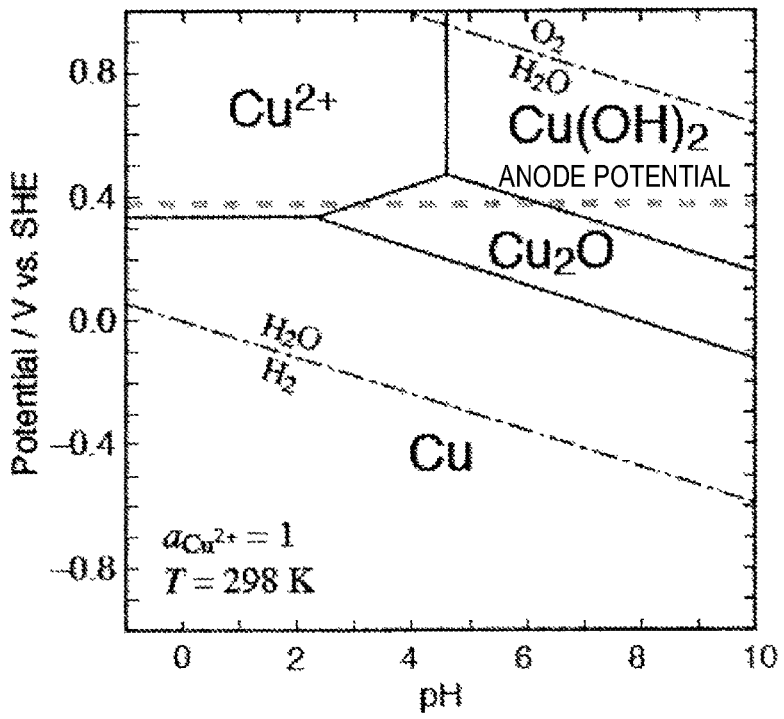

[Figure 2]
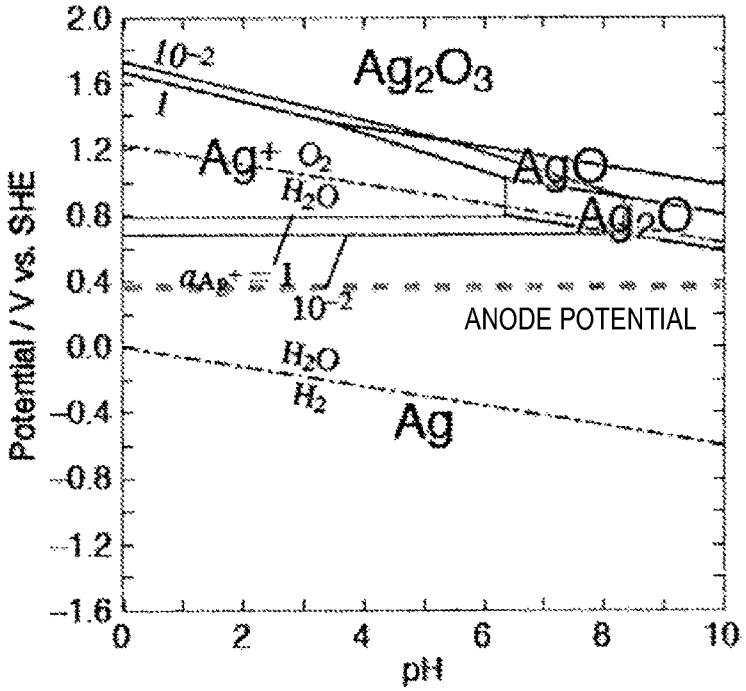

[Figure 3]
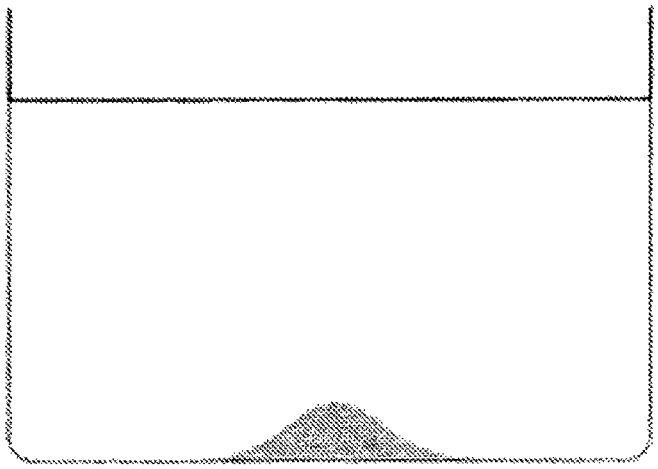
[Figure 4]
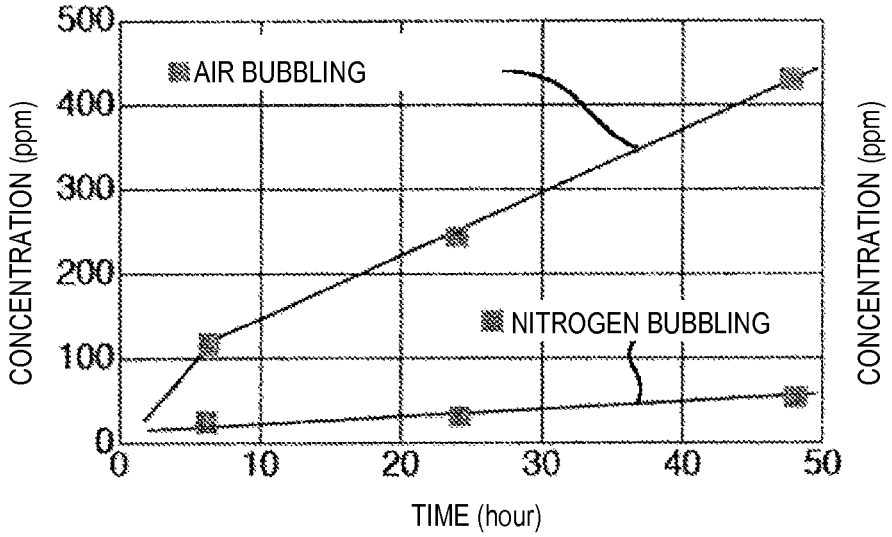

[Figure 5]
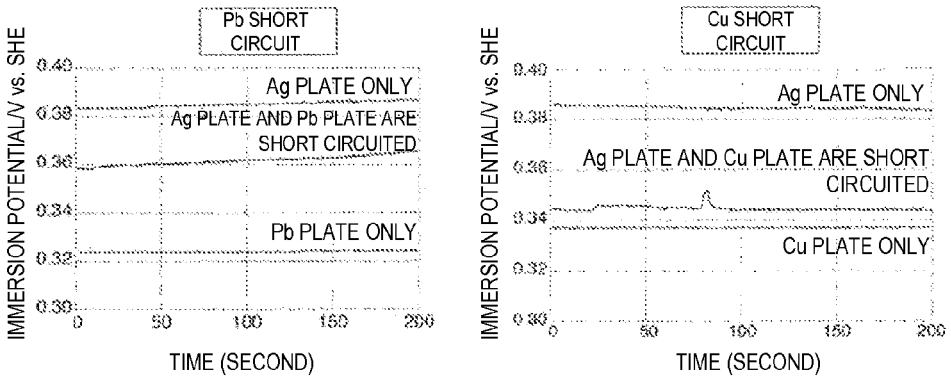
[Figure 6]
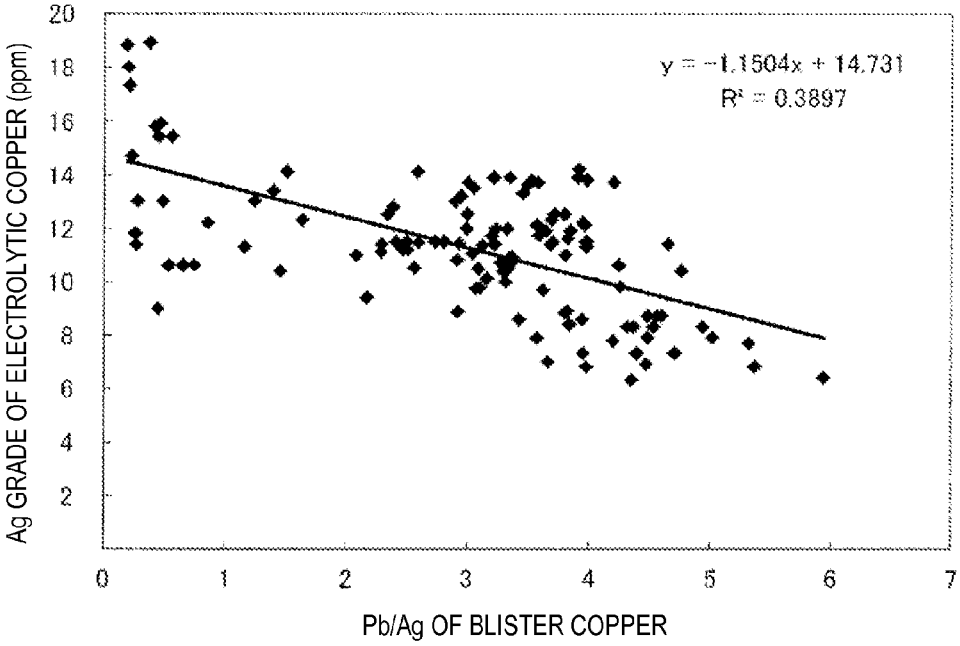

METHOD FOR MANUFACTURING ELECTROLYTIC COPPER

TECHNICAL FIELD

The present invention relates to a method for manufacturing electrolytic copper, more specifically, a useful method for manufacturing electrolytic copper with low-grade Ag by suppressing the Ag concentration in an electrolyte.

BACKGROUND ART

In manufacturing electrolytic copper, electrolytic refining is usually performed in a sulfuric acid based electrolyte, using blister copper refined to a copper grade of about 99%. Noble metals such as gold and silver contained as impurities in blister copper are precipitated as anode slime. The profit in the entire process is enhanced by increasing the recovery rate of the noble metals.

If the noble metals are incorporated in electrolytic copper without migration into the anode slime, a loss of noble metals as products is caused. A useful technique for decreasing the Ag grade in electrolytic copper is therefore required. At the present time, in Saganoseki Smelter and Refinery of Pan Pacific Co., Ltd., the silver grade (silver content) in electrolytic copper is about 10 ppm. It is estimated that the decrease in silver grade to 5 ppm increases the production of silver by 1 ton per year.

As the cause of incorporation of Ag into electrolytic copper, the mechanical "entanglement" of anode slime may be considered, and the reductive electrodeposition of Ag ions dissolved in an electrolyte at cathode may also be considered. Examples of the known methods for decreasing the Ag grade in electrolytic copper by electro-sliming Ag ions in an electrolyte include adding a small amount of chloride ions to an electrolyte, so that Ag is precipitated and collected as electrolytic slime in a silver chloride form. In the method, the chloride ion concentration in the electrolyte is set to higher than 30 mg/L and 60 mg/L or less, and the temperature of an electrolyte in the vicinity of cathode is adjusted to 55° C. or lower, so that the solubility of silver chloride is decreased to accelerate the sliming of silver ions (Patent Literature 1).

Although a method for suppressing the Ag grade in electrolytic copper is known, as described above, the elution mechanism of Ag is not sufficiently known. Patent Literature 2 proposes to maintain the dissolved oxygen in an electrolyte at 3.0 mg/L or less, in manufacturing high-purity electrolytic copper by reelectrolysis of electrolytic copper as an anode in a sulfuric acid electrolytic bath. However, the technique has different conditions from those for manufacturing electrolytic copper from blister copper as an anode.

CITATION LIST

Patent Literature

[Patent Literature 1] Japanese Patent Laid-Open No. 8-176878

[Patent Literature 2] Japanese Patent Laid-Open No. 1-139788

SUMMARY OF INVENTION

Technical Problem

As described above, a technique for improving the recovery rate of Ag in electrolytic refining of copper is proposed in Patent Literature 1, and a technique for suppressing the Ag grade in electrolytic copper in manufacturing electrolytic copper is proposed in Patent Literature 2. However, a method for manufacturing high-grade electrolytic copper by suppressing elution of Ag from blister copper in electrolysis of the blister copper is a different technique, and thus there is still room for improvement.

It is an object of the present invention, in view of these circumstances, to provide a method for manufacturing electrolytic copper having low Ag grade by sufficiently suppressing an Ag concentration in an electrolyte.

Solution to Problem

Through extensive study for solving the problem, the present inventors found that the Ag concentration in an electrolyte can be sufficiently suppressed, by performing electrolysis with an elution potential of Ag maintained higher than a potential of blister copper as anode or by performing electrolysis with a dissolved oxygen concentration in an electrolyte maintained at a predetermined value or lower.

In an aspect of the present invention completed based on the finding described above, a method for manufacturing electrolytic copper includes a step of performing electrolysis using an Ag-containing blister copper as anode with an anode potential maintained relatively lower than an elution potential of Ag in sulfuric acid solution.

In an embodiment, the method for manufacturing electrolytic copper of the present invention includes performing the electrolysis with an immersion potential of Ag lowered by the presence of Cu or a metal less noble than Cu in an electrolyte.

In another embodiment of the method for manufacturing electrolytic copper of the present invention, the metal is one or two selected from the group consisting of Pb and Cu.

In a further embodiment of the method for manufacturing electrolytic copper of the present invention, the metal is present in a solid form in an electrolyte.

In a further embodiment of the method for manufacturing electrolytic copper of the present invention, the electrolyte contains a precipitate including Ag, and the electrolysis is performed in a state that a metal less noble than Ag that shifts a surface potential of Ag particles in the precipitate to a less noble direction is electrically conducted to Ag in the precipitate.

In a further embodiment of the method for manufacturing electrolytic copper of the present invention, the metal less noble than Ag that shifts a surface potential of Ag particles in the precipitate to a less noble direction is one or two selected from the group consisting of Pb and Cu.

In a further embodiment of the method for manufacturing electrolytic copper of the present invention, the electrolysis is performed in an electrolysis cell and at least a part of a region of the electrolysis cell in contact with the electrolyte is made of a material containing the metal.

In a further embodiment of the method for manufacturing electrolytic copper of the present invention, the electrolysis is performed using the blister copper with an increased grade of the metal as anode.

In a further embodiment of the method for manufacturing electrolytic copper of the present invention, the ratio of a Pb grade (ppm) to an Ag grade (ppm) in the blister copper for use as anode, i.e. Pb/Ag, is 0.5 or more.

In a further embodiment of the method for manufacturing electrolytic copper of the present invention, the ratio of a Pb grade (ppm) to an Ag grade (ppm) in the blister copper for use as anode, i.e. Pb/Ag, is 2.0 or more.

In a further embodiment of the method for manufacturing electrolytic copper of the present invention, the ratio of a Pb grade (ppm) to an Ag grade (ppm) in the blister copper for use as anode, i.e. Pb/Ag, is 3.0 or more.

In a further embodiment of the method for manufacturing electrolytic copper of the present invention, the ratio of a Pb grade (ppm) to an Ag grade (ppm) in the blister copper for use as anode, i.e. Pb/Ag, is 5.0 or more.

In a further embodiment of the method for manufacturing electrolytic copper of the present invention, the electrolysis is performed using an electrolyte containing additive supplying ions that bond with Ag ions to form an Ag compound.

In a further embodiment of the method for manufacturing electrolytic copper of the present invention, the additive is one or two selected from the group consisting of thiourea and chloride ions.

In another aspect of the present invention, the method for manufacturing electrolytic copper includes a step of performing electrolysis using an Ag-containing blister copper as anode with a dissolved oxygen concentration in an electrolyte maintained at 3 mg/L or less in sulfuric acid solution.

In a further embodiment of the method for manufacturing electrolytic copper of the present invention, the dissolved oxygen concentration in the electrolyte is controlled by performing deoxidization treatment with bubbling of an inert gas through the electrolyte.

In a further embodiment of the method for manufacturing electrolytic copper of the present invention, the inert gas for use is nitrogen gas discharged from an oxygen plant.

In a further embodiment of the method for manufacturing electrolytic copper of the present invention, the electrolysis is performed in an electrolysis cell and the electrolysis is performed using a circulation path for an electrolyte having a structure to prevent bubbles of oxygen-containing gas from being mixed with the electrolyte, to thereby control a dissolved oxygen concentration in the electrolyte.

In a further embodiment of the method for manufacturing electrolytic copper of the present invention, the electrolysis is performed using an electrolyte containing additive supplying ions that bond with Ag ions to form an Ag compound.

In a further embodiment of the method for manufacturing electrolytic copper of the present invention, the additive is one or two selected from the group consisting of thiourea and chloride ions.

Advantageous Effects of Invention

The present invention can provide a method for manufacturing electrolytic copper having a low Ag grade, by sufficiently suppressing the Ag concentration in an electrolyte.

BRIEF DESCRIPTION OF DRAWINGS

FIG. 1 is a diagram showing the anode potential in a normal electrolytic refining of copper and the potential vs. pH for Cu.

FIG. 2 is a diagram showing the anode potential in a normal electrolytic refining of copper and the potential vs. pH for Ag.

FIG. 3 is a schematic diagram showing a non-conductive vessel provided with a copper electrolyte in testing for investigating the effect of dissolved oxygen in Examples.

FIG. 4 is a diagram showing the transition of Ag concentration in liquid vs. time period from the start of agitation in testing for investigating the effect of dissolved oxygen in Example 1.

FIG. 5 is a diagram showing the immersion potential of an Ag plate when the Ag plate is short-circuited with a Pb plate or a Cu plate in testing for investigating the effect of contact with lead or copper in Example 2.

FIG. 6 is a diagram showing the relations between the Pb/Ag of blister copper and the Ag grade of electrolytic copper in Example 4.

DESCRIPTION OF EMBODIMENTS

Embodiments of the method for manufacturing electrolytic copper of the present invention are described in detail below.

<Anode>

The anode for use in the electrolytic refining in the method for manufacturing electrolytic copper of the present invention is prepared by casting after subjecting blister copper having a copper grade of about 93 to 99 mass %, typically 97 to 99 mass %, obtained from a converter furnace process to oxidation smelting and reduction treatment and usually has a plate shape. The Ag grade in blister copper is generally about 300 to 1000 g/t, but not limited thereto.

<Cathode>

Examples of the cathode for use in electrolytic refining in the method for manufacturing electrolytic copper of the present invention include those prepared by the method using a starting sheet and also by a so-called permanent cathode method (PC method) which uses a stainless steel plate for electrodeposition of copper on the surface thereof, but not limited thereto. The material for the permanent cathode is not specifically limited, but generally, titanium and stainless steel are used due to insolubility in an electrolyte. The use of stainless steel is preferred due to the low costs. The type of stainless steel is not specifically limited, and any of martensite-based stainless steel, ferrite-based stainless steel, austenite-based stainless steel, austenite/ferrite biphase stainless steel, and deposition hardening stainless steel may be used.

<Electrolyte>

In the method for manufacturing electrolytic copper of the present invention, a sulfuric acid based electrolyte may be used for performing electrolytic refining of copper. Generally, the sulfuric acid concentration is in the range of 120 to 220 g/L, and the Cu ion concentration is in the range of 40 to 60 g/L, but not limited thereto. Typically, the sulfuric acid concentration is in the range of 160 to 180 g/L, and the Cu ion concentration is in the range of 45 to 55 g/L.

In electrolytic refining of copper, additives are generally added to the electrolyte. The additives are used for improving the deposition conditions of copper at a cathode plate. Examples of the organic additives include an additive to form a protective colloid such as glue, gelatin, and lignin (pulp waste fluid), and an organic compound or the like having a functional group such as thiourea and aloin, which are used together. The activation polarization during deposition is generally increased with the additives. The enhanced polarization improves the uniformity of electrodeposition, so that a dense deposited metal with a uniform surface can be obtained.

In order to prevent the dissolved silver ions from blister copper from being incorporated in electrolytic copper, and further, in order to collect valuable Ag, preferably additive supplying ions that bond with silver ions to form an Ag compound is added into the electrolyte for electrolysis. Preferred examples of the additive include one or two selected from the group consisting of thiourea and chloride ions. In particular, thiourea and chloride ions are more preferred, capable of achieving smoothened surface of electrolytic copper and uniform electrodeposition. The sulfur oxides generated by the decomposition of thiourea, and chloride ions are bonded to silver ions so as to form a coating of Ag compounds on the surface of Ag particles, which suppresses the oxidation and dissolution of Ag. On this occasion, in the case of adding thiourea, the concentration of thiourea in an electrolyte is preferably 2 to 8 mg/L, typically 3 to 5 mg/L. In the case of adding hydrochloric acid as a source for supplying chloride ions, the concentration of chloride ions in an electrolyte is about 30 to 80 mg/L, typically about 50 to 70 mg/L, but not limited thereto. On this occasion, the solubility product (Ksp) of AgCl (solid) is $1.6\times10^{-10}$, so that the optimal concentration of chloride ions in an electrolyte can be adjusted based on the relations with the concentration of silver ions in the electrolyte.

<Electrolytic Refining>

In an industrial manufacturing process of electrolytic copper, plural electrolysis cells are disposed, in which plural cathodes and anodes (e.g. 40 to 60 sheets for each) are installed. A copper electrolyte is continuously supplied to the electrolysis cells and continuously discharged by overflow.

The anode potential in normal electrolytic refining of copper and the potential vs. pH diagrams for Cu and Ag are shown in FIG. 1 and FIG. 2. Since the normal anode potential is +0.37 to 0.40 V (vs. SHE), the anode copper dissolves to have a stable $Cu^{2+}$ form as shown in FIG. 1. On the other hand, Ag ought not to be eluted, having a thermodynamically stable Ag form. In fact, however, the Ag concentration in an electrolyte increases as the electrolysis proceeds. It is therefore presumed that Ag is eluted in the electrolyte for some reason. In manufacturing of electrolytic copper from blister copper, such elution of Ag from blister copper allows Ag to commingle into the electrolytic copper as impurities, lowering the grade of the electrolytic copper. In electrolytic refining in the method for manufacturing electrolytic copper of the present invention using an Ag-containing blister copper as anode, electrolysis is performed in sulfuric acid solution, while maintaining the anode potential lower than the elution potential of Ag. Such a configuration sufficiently suppresses the elution of Ag into an electrolyte. The term "anode potential" represents the potential on the anode side when the current flows by electrolysis, which is the potential obtained by connecting a fixed point of the anode to a reference electrode (e.g. silver-silver chloride electrode). The term "elution potential of Ag" represents the level of electron energy required for the solid Ag contained in blister copper to emit an electron for elution into electrolyte. With the elution potential of Ag being 0.79 V, to control the potential at a potential lower than the elution potential of Ag, or to use the principle of sacrificial electrode (to contact with a metal less noble than Ag in terms of the elution potential, causing elution of the less noble metal, suppressing the elution of Ag), is effective for suppressing the elution of Ag.

The electrolysis may be performed in a state with an immersion potential of Ag lowered by the presence of Cu or a metal less noble than Cu in an electrolyte. The "immersion potential" represents the potential generated in a state that the anode and the cathode electrically connected are immersed in an electrolyte. The presence of Cu or a metal less noble than Cu in the electrolyte generates electrochemical interaction between the metal and Ag due to the contact corrosion phenomenon between different metals. The corrosion rate of the metal less noble in the ionization tendency, therefore, increases, while the corrosion rate of Ag noble in the ionization tendency decreases. Consequently, the immersion potential of Ag lowers. Such electrolysis in a state with an immersion potential of Ag lowered allows more sufficient suppression of the elution of Ag from the blister copper into an electrolyte. Examples of Cu or the metal less noble than Cu used herein include one or two selected from the group consisting of Pb and Cu. The metal may be present in a solid form in an electrolyte. Theoretically, the metal is not deposited by electrolysis, so that the upper limit of the concentration in an electrolyte is not particularly restricted. Regarding the lower limit of the concentration, no matter how small the amount is, the metal has effect as long as Ag is electrically short circuited to the anode or the electrolytic slime, in a short term. For a sustainable effect, the amount of sacrificial anode metal that compensates the amount of electrons involved in oxidization of Ag contained in the anode and the precipitate to $Ag^{+}$ is required. For example, the required amount of Pb is ½ of the molar amount of Ag, since Pb usually makes divalent cation. For the metal of Pb, the upper limit and the lower limit of the concentration of Pb contained in the anode are specified. The anode contains Pb in an amount of, generally 100 to 5000 ppm, typically 500 to 1500 ppm. In the viewpoint that the concentration of Pb contained in anode higher than the average concentration is preferred, the lower limit is set to about 1000 ppm. In the viewpoint that the concentration within the common-sense range is preferred, the upper limit is set to 5000 ppm.

The blister copper for use as anode in electrolysis has a ratio of a Pb grade (ppm) to an Ag grade (ppm), i.e. Pb/Ag, of preferably 0.5 or more. With the blister copper having a controlled Pb/Ag of 0.5 or more, the Ag grade of the electrolytic copper obtained by electrolysis can be more effectively decreased. Further, the blister copper having a ratio of a Pb grade (ppm) to an Ag grade (ppm), i.e. Pb/Ag, of 2.0 or more, 2.5 or more, 3.0 or more, 3.5 or more, 4.0 or more, 4.5 or more, or 5.0 or more is more preferred from the viewpoint of the decrease in Ag grade of each electrolytic copper.

Under the presence of Ag-containing precipitate in an electrolyte, the electrolysis may be performed in a state that a metal less noble than Ag that shifts a surface potential of Ag particles in the precipitate to a less noble direction is electrically conducted to Ag in the precipitate. The elution of Ag from the precipitate may increase the Ag grade of electrolytic copper due to the incorporation of Ag into the electrolytic copper. The electrolysis is, therefore, performed in the state that a metal less noble than Ag is electrically conducted to Ag in the precipitate, so that the surface potential of the Ag particle in the precipitate is shifted to the less noble direction for suppressing the elution of Ag. The precipitate is, for example, an anode slime of precipitated noble metals in blister copper. Examples of the metal less noble than Ag that shifts a surface potential of Ag particle in a precipitate to a less noble direction include one or two for use selected from the group consisting of Pb and Cu. Examples of the means for electrically conducting the metal less noble than Ag to Ag in the precipitate in an electrolyte may include applying Pb lining to the lining of an electrolysis cell or immersing a Pb block such as a Pb plate at the bottom of an electrolysis cell.

The electrolysis is performed in an electrolysis cell, and at least a part of the region of the electrolysis cell in contact with the electrolyte may be made of the metal. Further, the electrolysis may be performed with use of blister copper having an increased grade of the metal as anode. Such a configuration enables the metal to be easily and stably supplied into the electrolyte.

In the electrolytic refining in the method for manufacturing electrolytic copper of the present invention, electrolysis may be performed, with a dissolved oxygen concentration in an electrolyte maintained at 3 mg/L or less in sulfuric acid solution, using an Ag-containing blister copper as anode. The present inventors found through the study close relations between the amount of dissolved oxygen in an electrolyte during electrolysis and the elution amount of Ag from blister copper. In some cases, the discharged liquid of an electrolyte may be subject to a step, so-called oxygen producing electrolysis, for removal of excessively accumulated copper content and impurities from the liquid. In the oxygen producing electrolysis, electrolysis is performed with use of a Pb plate as anode, so that a reaction $H_2O=\frac{1}{2}O_2+2H^++2e^-$ occurs to generate oxygen. Consequently, the dissolved oxygen concentration in the solution increases to 4 to 5 mg/L after the oxygen producing electrolysis. Even a small decrease in dissolved oxygen concentration is effective. Accordingly, electrolysis is performed with the dissolved oxygen concentration maintained at 3 mg/L or less in sulfuric acid solution, so that oxidizers in an electrolyte decrease and the elution of Ag from blister copper to the electrolyte can be sufficiently suppressed. In the case of returning electrolysis drainage through filtration only, without the oxygen producing electrolysis, the increase of dissolved oxygen is caused only to a limited extent by air trapping in pumping and in a filtration step. In such a case, it is believed that the dissolved oxygen concentration is about 1 mg/L before supplying. Accordingly, a concentration equal to or less than the level is more effective. Therefore, the dissolved oxygen concentration in an electrolyte is preferably maintained at 1 mg/L or less. Further, since the dissolved oxygen concentration in electrolysis drainage is about 0.05 mg/L, it is believed that almost no dissolution of Ag occurs by dissolved oxygen as long as the dissolved oxygen concentration in the feed liquid is 0.1 mg/L or less. The dissolved oxygen concentration in an electrolyte is therefore more preferably maintained at 0.1 mg/L or less.

Examples of control of the dissolved oxygen concentration in an electrolyte include a deoxidization treatment with bubbling of an inert gas through the electrolyte. Examples of the inert gas for use may include nitrogen gas discharged from an oxygen plant. As a more specific embodiment, the following method may be conceivable. The electrolyte is consistently circulated. The liquid discharged from each electrolysis cell is gathered in a drainage tank and passes through a filter for removal of suspended solid particles in the electrolyte. The liquid part is then pumped to a supply tank and returned to the electrolysis cell. On this occasion, the supply of the liquid subjected to bubbling with an inert gas in the supply tank enables electrolysis with a dissolved oxygen concentration lower than the conventional level. Due to possibility of the dissolution of oxygen in air through the surface of an electrolyte, examples of the method for continuously suppressing the dissolved oxygen concentration in an electrolyte may include using a circulation path for an electrolyte having a structure for preventing oxygen-containing gas from commingling with the electrolyte as bubbles in electrolysis. More specifically, when the discharge liquid is returned to a supply tank from an electrolyte pumping pipe, use of a circulation path for an electrolyte having a structure for direct return into the electrolyte without contacting air through piping extending to the bottom of the tank may be conceivable, instead of the supply by dropping the liquid from the top of the tank. Further, in control of the dissolved oxygen concentration in the electrolyte, a deoxidizing treatment may be performed by applying pressure to the electrolyte with a pressure pump or the like, or a deoxidizing agent may be added to the electrolyte.

EXAMPLES

The following examples of the present invention are provided for illustrative purpose only, and are not intended to limit the scope of the invention.

Example 1: Influence of Dissolved Oxygen

In FIG. 3, a schematic diagram of testing performed for the investigation is shown. In the testing, 300 mL of a normal copper electrolyte ($CuSO_4$ concentration: 0.76 mol/$dm^3$, $H_2SO_4$ concentration: 1.94 mol/$dm^3$, liquid temperature: 65° C.) was poured into a non-conductive vessel as shown in FIG. 3, in which 10 g of silver particles (particle size: 425 to 850 μm) were added to form deposition. The resultant was continuously agitated at an agitation rate of 200 rpm. Each immersion was performed for 6 hours, 24 hours, and 48 hours, at a bath temperature of 65° C., under air bubbling and nitrogen bubbling. After immersion, the Ag particles were collected and subjected to weight measurement with a micro balance. As a result, weight decrease was observed in the Ag particles. The relations between the dissolved amount of silver ions calculated from the weight decrease and the immersion time are shown in FIG. 4.

As shown in FIG. 4, the concentration of Ag increased in proportion to the time when air bubbling was performed, showing the occurrence of elution of Ag. On the other hand, the concentration of Ag was kept at an approximately constant level with time when nitrogen bubbling was performed, so that the dissolved amount of Ag significantly decreased compared with the case by air bubbling. The same trend was observed in the results of quantitative determination by ICP emission spectroscopy. From the above, it was demonstrated that Ag particles are gradually oxidized and dissolved by dissolved oxygen. In combination with the XPS results of state analysis of silver in blister copper, which demonstrated the presence of silver as elemental Ag, it was confirmed that a factor for increasing the Ag grade in electrolytic copper was caused by deposition of silver ions dissolved by the redox reaction between silver in the anode slime and the dissolved oxygen, at the cathode.

Example 2: Influence of Contact with Lead or Copper

For verification of an assumption that electrochemical contact between Ag and Pb in blister copper suppresses the oxidation and dissolution of Ag, the immersion potential of an Ag plate was measured in a state that the Ag plate and a Pb plate were short circuited in a copper electrolyte ($CuSO_4$ concentration: 0.76 mol/$dm^3$, $H_2SO_4$ concentration: 1.94 mol/$dm^3$, liquid temperature: 65° C.). Considering the state of silver in blister copper, which is in contact with copper, the same measurement was performed on the copper plate. No additive was added to the electrolytic bath, and a lead wire was used for short circuiting. The measurement results of the immersion potential are shown in FIG. 5, together with the immersion potential for an Ag plate only, a Cu plate only, and a Pb plate only. As shown in FIG. 5, the immersion potential of the Ag plate short circuited to the Pb plate or the Cu plate is shifted from the immersion potential of the Ag plate only toward a less noble direction by about 20 mV or 40 mV. From the above, the possibility is high that the oxidation and dissolution of Ag is suppressed by the contact with Pb or Cu.

When Ag particles were immersed in a bath for 2 days in a state placed on a Pb plate or a Cu plate, the amount of silver dissolved into a bath was determined by ICP emission spectroscopy. In any of the cases, aeration was performed. The amount of dissolution was about 400 ppm for the immersion without contact with a Pb plate or a Cu plate. In contrast, the amount of dissolution was 1 ppm or less in any immersion in contact with the plate. From the above, it was shown that the dissolution of Ag is suppressed by the contact with Pb or Cu.

Example 3: Influence of Additives

In order to investigate the influence of additives such as thiourea and chloride ions contained in an electrolytic bath on the oxidation and dissolution of Ag, immersion experiments on Ag particles were performed for the case with additives and without additives, respectively. The components of the electrolytic bath were as follows.

Electrolytic bath with additives: $CuSO_4$ concentration: 0.76 mol/dm$^3$, $H_2SO_4$ concentration: 1.94 mol/dm$^3$, $Cl^-$: 60 mg/dm$^3$, thiourea: 5.0 mg/dm$^3$, liquid temperature: 65° C., liquid volume: 300 mL.

Electrolytic bath without additives: $CuSO_4$ concentration: 0.76 mol/dm$^3$, $H_2SO_4$ concentration: 1.94 mol/dm$^3$, liquid temperature: 65° C., liquid volume: 300 mL.

Silver particles in an amount of 10 g (particle size: 425 to 850 μm) were immersed in each of the cases.

The immersion was performed for 2 days, and the amount of silver dissolved in the bath was then determined by ICP emission spectrometry. In the observation of the external view of Ag particles collected after the experiment, the particles immersed in the bath without additives kept the same white color as before the experiment, while the particles immersed in the bath with additives caused blackening of the particle surface. By EDX analysis of the surface components, the components of 60% of silver, 35% of chlorine, and 3% of sulfur were identified in the particles with additives. It is therefore highly possible that the Ag particles immersed in the electrolytic bath with additives allow a part of oxidized Ag to combine with chloride ions in the bath or sulfur components generated by the decomposition of thiourea. It is believed that the blackening of surface was caused by the generation of silver sulfide. Meanwhile, from the results of determination of the amount of silver dissolved in each electrolytic bath, it was found that while the amount was about 400 ppm in the case without additives, the amount was decreased to about 170 ppm in the case with additives. From the above, it is highly possible that a coating of silver chloride or silver sulfide is formed on the surface of Ag particles in the case of a bath containing additives, which suppresses the oxidation and dissolution of Ag.

In a further immersion experiment, Ag particles were immersed in an electrolytic bath with additives for 2 days in a state in which the Ag particles were placed on a Pb plate or a Cu plate, and the amount of dissolved silver determined in a similar manner was 1 ppm or less. From the above, it was shown that the oxidation and dissolution of Ag can be significantly suppressed due to the contact with Pb or Cu, regardless of the presence or the absence of additives. The surface of collected particles at this time was not blackened in spite of the immersion in an electrolytic bath with additives, and it was confirmed that a part of the Cu plate, at the periphery of the Ag particles disposed thereon, was blackened. It is believed that the oxidation of Ag is suppressed by the contact with Pb or Cu, so that the lead or copper in the vicinity was preferentially oxidized to form a compound such as lead sulfate or copper sulfide.

Example 4: Influence of Pb/Ag of Blister Copper

In order to investigate the influence of the Pb/Ag grade in blister copper for use as anode on the Ag grade of electrolytic copper, the following electrolysis experiment was performed.

A blister copper which contains Pb and Ag was used as anode. Plural blister coppers having difference in the ratio of a Pb grade (ppm) to an Ag grade (ppm), i.e. Pb/Ag, were prepared. A stainless plate was used as cathode.

Subsequently, electrolysis was performed in sulfuric acid solution. The electrolysis conditions were adjusted to within the following ranges.

Composition of an electrolyte: $CuSO_4$ concentration: 40 to 60 g/L, $H_2SO_4$ concentration: 160 to 180 g/L, $Cl^-$: 50 to 70 mg/dm$^3$, thiourea: 3 to 5 mg/dm$^3$;

Temperature of an electrolyte: 64 to 67° C.;

Electrolysis cell: 1280 mm long×5550 mm wide×1340 mm deep;

Anode: 50 sheets of blister copper 1060 mm long×990 mm wide×45 mm thick;

Cathode: 49 starting sheets or stainless plates 1040 mm long×1040 mm wide×10 mm thick;

Distance between electrodes: 100 mm;

Circulating electrolyte flow rate: 34 to 36 L/min;

Energizing time: 9 to 10 days.

In FIG. 6, a graph showing the relations between the Pb/Ag of blister copper and the Ag grade of electrolytic copper obtained in the experiment is provided. The straight line in the graph represents an approximate curve ($y=-1.1504x+14.731$, $R^2=0.3897$) for the plotted data.

From FIG. 6, it is shown that the Ag grade of electrolytic copper can be decreased with the increase of Pb/Ag in blister copper, due to the negative correlation between the Pb/Ag in blister copper and the Ag grade of electrolytic copper.

It is also shown that the Ag grade of electrolytic copper rapidly increases with the decrease of Pb/Ag in blister copper to less than 0.5.

With a Pb/Ag in blister copper of 2 or more, 2.5 or more, and 3.0 or more, the fluctuation range of the Ag grade of electrolytic copper for the same Pb/Ag decreases, so that an Ag grade in electrolytic copper extremely higher than the approximate curve does not occur, which is preferred. Although the fluctuation range of the Ag grade of electrolytic copper for the same Pb/Ag seems to be smaller particularly in the vicinity of a Pb/Ag in blister copper of 1 or more and less than 2 in comparison with the case having a Pb/Ag in blister copper of 2 or more in FIG. 6, it is believed that this was caused due to an insufficient number of experiments for a Pb/Ag in blister copper of 1 or more and less than 2.

Further, with a Pb/Ag in blister copper of 4.5 or more, and 5 or more, the Ag grade of electrolytic copper was lower than the approximate curve in great many cases, so that preferred results were obtained from the viewpoints of securing the effect by reliable addition of Pb.

The invention claimed is:

1. A method for manufacturing electrolytic copper comprising a step of performing electrolysis using Ag-containing blister copper as anode with an anode potential maintained lower than an elution potential of Ag and with an immersion potential of Ag lowered by the presence of a metal less noble than Cu in the blister copper in sulfuric acid solution, wherein the electrolysis is performed using the blister copper, and the ratio of a Pb grade (ppm) to an Ag grade (ppm) in the blister copper for use as anode is 2.0 or more.

2. The method for manufacturing electrolytic copper according to claim 1, wherein the electrolysis is performed in an electrolysis cell and at least a part of a region of the electrolysis cell in contact with the electrolyte is made of a material containing the metal.

3. The method for manufacturing electrolytic copper according to claim 1, wherein the ratio of a Pb grade (ppm) to an Ag grade (ppm) in the blister copper for use as anode is 3.0 or more.

4. The method for manufacturing electrolytic copper according to claim 3, wherein the electrolysis is performed in an electrolysis cell and at least a part of a region of the electrolysis cell in contact with the electrolyte is made of a material containing the metal.

5. The method for manufacturing electrolytic copper according to claim 3, wherein the ratio of a Pb grade (ppm) to an Ag grade (ppm) in the blister copper for use as anode is 5.0 or more.

6. The method for manufacturing electrolytic copper according to claim 5, wherein the electrolysis is performed in an electrolysis cell and at least a part of a region of the electrolysis cell in contact with the electrolyte is made of a material containing the metal.

7. A method for manufacturing electrolytic copper comprising a step of performing electrolysis using Ag-containing blister copper as anode with an anode potential maintained lower than an elution potential of Ag with an immersion potential of Ag lowered by the presence of a metal less noble than Cu in the blister copper in sulfuric acid solution, wherein an electrolyte contains a precipitate including Ag, and the electrolysis is performed in a state that a metal less noble than Ag that shifts a surface potential of Ag particles in the precipitate to a less noble direction is present in the solid form other than electrode in the electrolyte by applying the metal less noble than Ag to the lining of an electrolysis cell or immersing a metal block at the bottom of an electrolysis cell, and is electrically conducted to Ag in the precipitate.

8. The method for manufacturing electrolytic copper according to claim 7, wherein the metal less noble than Ag that shifts a surface potential of Ag particles in the precipitate to a less noble direction is one or two selected from the group consisting of Pb and Cu.

9. The method for manufacturing electrolytic copper according to claim 8, wherein the electrolysis is performed in an electrolysis cell and at least a part of a region of the electrolysis cell in contact with the electrolyte is made of a material containing the metal.

10. The method for manufacturing electrolytic copper according to claim 7, wherein the electrolysis is performed in an electrolysis cell and at least a part of a region of the electrolysis cell in contact with the electrolyte is made of a material containing the metal.

11. The method for manufacturing electrolytic copper according to claim 7, wherein the electrolysis is performed using an electrolyte containing additive supplying ions that bond with Ag ions to form an Ag compound.

12. The method for manufacturing electrolytic copper according to claim 11, wherein the additive is one or two selected from the group consisting of thiourea and chloride ions.

13. A method for manufacturing electrolytic copper comprising a step of performing electrolysis using Ag-containing blister copper as anode with an anode potential maintained lower than an elution potential of Ag and with an immersion potential of Ag lowered by the presence of a metal less noble than Cu in the blister copper in sulfuric acid solution, wherein the metal is Pb, and the electrolysis is performed in an electrolysis cell and at least a part of a region of the electrolysis cell in contact with the electrolyte is made of a material containing the metal, and wherein the part of the region of the electrolysis cell in contact with the electrolyte is the lining of the electrolysis cell or a metal block immersed in the electrolysis cell.

* * * * *